US008281774B2

(12) United States Patent
Grace

(10) Patent No.: US 8,281,774 B2
(45) Date of Patent: Oct. 9, 2012

(54) CAM ADJUSTMENT MODULE FOR COMPOUND ARCHERY BOW

(75) Inventor: Nathaniel E. Grace, Port Huron, MI (US)

(73) Assignee: Grace Engineering Corp., Memphis, MI (US)

( * ) Notice: Subject to any disclaimer, the term of this patent is extended or adjusted under 35 U.S.C. 154(b) by 321 days.

(21) Appl. No.: 12/847,006

(22) Filed: Jul. 30, 2010

(65) Prior Publication Data

US 2011/0023857 A1 Feb. 3, 2011

Related U.S. Application Data

(60) Provisional application No. 61/230,340, filed on Jul. 31, 2009.

(51) Int. Cl.
*F41B 5/10* (2006.01)

(52) U.S. Cl. ..... 124/25.6; 124/900

(58) Field of Classification Search ..... 124/25.6, 124/900

See application file for complete search history.

(56) References Cited

U.S. PATENT DOCUMENTS

| | | | | |
|---|---|---|---|---|
| 3,990,425 | A | 11/1976 | Ketchum | |
| 4,957,094 | A | 9/1990 | Pickering et al. | |
| 6,360,735 | B1 | 3/2002 | Larson et al. | |
| 6,516,790 | B1 | 2/2003 | Darlington | |
| 6,688,295 | B1 | 2/2004 | Miller | |
| 7,188,615 | B2 * | 3/2007 | Chang | 124/25.6 |
| 7,690,372 | B2 * | 4/2010 | Cooper et al. | 124/25.6 |
| 7,770,568 | B1 * | 8/2010 | Yehle | 124/25.6 |
| 2009/0188482 | A1 | 7/2009 | Strother | |
| 2009/0255520 | A1 | 10/2009 | Strother | |
| 2009/0288650 | A1 | 11/2009 | Batdorf | |
| 2010/0101549 | A1 | 4/2010 | Grace et al. | |

* cited by examiner

*Primary Examiner* — John Ricci

(74) *Attorney, Agent, or Firm* — Warner Norcross & Judd LLP

(57) ABSTRACT

A cam system for an archery bow including a module that is readily attached to and detached from a cam while leaving the cam on the bow. The module can include a draw stop selectively moveable relative to the module, even while the module is joined with the cam, to adjust the draw stop to specific locations corresponding to different draw lengths and/or draw stop walls of the bow. The module can include a recess that surrounds only part of an axle joining the cam and bow so the entire module is removable from the cam without removing the axle. The cam system can include indexing features that precisely and consistently align features of the cam and module. These features can include first and second indexing posts, and corresponding indexing holes, that register with one another to precisely align the cam and module when joined.

20 Claims, 7 Drawing Sheets

CAM ADJUSTMENT MODULE FOR COMPOUND ARCHERY BOW

This application claims the benefit of U.S. Provisional Application 61/230,340, filed Jul. 31, 2009, which is hereby incorporated by reference.

BACKGROUND OF THE INVENTION

The present invention relates to compound archery bows, and more particularly to a cam system for a compound bow including an adjustment module.

Conventional compound archery bows include a bowstring and a set of cables, usually an up cable and a down cable, to transfer energy from the limbs and cams or pulleys of the bow to the bowstring, and thus to an arrow shot from the bow. The cables and/or bowstring are strung from a cam or pulley on one limb to a cam or pulley on another limb. The function of the cam system is to provide a mechanical advantage so that energy imparted to the arrow is a multiple of that required of an archer to draw the bow.

Most compound bows are outfitted with either single cam systems or dual cam systems, and are set-up to accommodate the specific draw length of the archer shooting the bow. As used herein, draw length generally refers to the distance, at full draw, between the nocking point of the arrow on the bowstring to the back of the grip on the bow. Regardless of the cam system, most systems include a mechanism that enables an archer to modify draw length of the bow so that it is suitable to their physical stature, to provide a stop location in the draw cycle of the bowstring so that the archer knows when the bow is fully drawn, and/or to provide the archer with a consistent reference associated with their preferred draw stop location.

Single cam systems usually include a single cam on a lower bow limb and a single track pulley on an opposing upper bow limb, with one cable and one bowstring, wrapped around the cam and/or pulley. Depending on the particular design, the cam system can be altered to adjust draw length with one of several constructions.

In one construction, the entire cam can be replaced with another cam having different draw length characteristics. In another construction, the cam can include a replaceable module, which module includes a groove for either the bowstring or the cable, attached to the cam. The module, in this instance, can be replaced with another module having different draw length characteristics. When replacing the module of this construction, extra care must be taken to remove and replace the cable or bowstring relative to the groove in the module. Further, special equipment, such as a bow press, may be required to replace the module of this construction. In addition, the module of this construction is usually joined to the cam with a screw threaded into a threaded hole defined by the cam. This simple screw attachment can sometimes lead to inappropriate registration of the module and the cam if the threads are not perfectly matched, if the threaded hole is not perfectly drilled, or if the screw or hole wear under the force of multiple draw cycles and shooting of the bow over time.

In yet another construction, called a "rotating module" design, a cam module includes a groove that accommodates a cable or a bowstring. The rotating module also includes a pivot point about which it is rotated and subsequently oriented relative to the cam in any one of several positions. The various rotational positions provide different draw length characteristics.

A conventional older cam system employs two cams, two cables, and one bowstring where each cable is connected on one end, by means of a yoke, to the axle of the opposite cam. One or both cams can include a rotating module or a fixed adjustment module, adapted to be rotated or changed out, respectively, to adjust draw length.

Another more recent variant of the dual cam system, often referred to as a "cam and a half," has one cable connected by a yoke to an axle on which one cam rotates and the other cable connected cam to cam. Still another variant employs a three-track cam design. A newer variation of the dual cam system can employ two-track cams of monolithic design—monolithic in the sense that there is no separate module for draw length adjustment. Draw length adjustment on the above cam variations can be provided by rotating a cam module or by removing and replacing one module with another as noted above.

While most conventional cam systems provide satisfactory performance, they require significant time and effort to adjust the draw length, the draw force curve of the bow and the draw stop. For cam systems that utilize cam module replacement for adjusting draw length, the usual added expense of servicing the bow by an experienced bow technician, or the use of a bow press, can be deterrents in making the draw length desired change. Further, the sometimes inaccurate or imprecise registration between a module and a cam can lead to premature wear on these components, as well as other components of the bow, such as the bowstring and the related axles. Accordingly, there remains room for improvement in cam system design to provide a relatively simple and precise way to adjust draw length, draw stop and the draw force curve of a cam system and an associated archery bow.

SUMMARY OF THE INVENTION

A cam system for a compound archery bow is provided including a module that can be readily attached to and detached from a cam while leaving the cam attached to the bow. The module and its components can be configured to provide certain performance characteristics, such as a particular draw length, draw stop and/or draw force for the bow, when joined with the cam.

In one embodiment, the module includes a draw stop joined with it. The draw stop can be selectively moveable relative to the module, even while the adjustment module is attached to the cam, to adjust the draw stop to specific locations. Each location can correspond to a different amount of rotation of the cam, and thus the associated draw length and/or draw stop of the bow. The draw stop can effectively set a desired draw length and/or reduce the potential for overdrawing the bow, which can result in a hazardous situation for the archer.

In another embodiment, the module can define an elongated slot. The draw stop can be selectively slideable relative to the slot when the draw stop is adjusted to the specific locations mentioned above.

In yet another embodiment, the module of the cam system can include a recess that circumferentiates only a portion of an axle that joins the cam with a limb of the archery bow. Accordingly, the entire module can be removed from the cam, and optionally exchanged for another module having different performance characteristics, without having to remove the axle from the limb.

In still another embodiment, the module and/or cam can include indexing features adapted to precisely and consistently align the features of the cam and module. These indexing features can be in the form of first and second indexing posts and indexing holes that precisely register with one another, to in turn precisely align the cam and module when they are joined with one another.

In a further embodiment, the cam system can be a dual cam system including two cam assemblies, which are mirror images of each other, mounted on the upper and lower limbs of a bow. Each cam assembly can include a cam, a module releasably secured to the cam, and fasteners that join the module and the cam.

In yet a further embodiment, a bowstring cam can include a bowstring groove, a bowstring anchor and optionally a slot for a draw stop. Further optionally, the cam also includes a bearing boss which defines a portion of a cable groove.

In still a further embodiment, the module can provide another, major portion of the cable groove, a cable anchor, and another slot for the draw stop which overlaps at least a portion of the slot for an optional draw stop in the cam, if included.

The cam system described herein provides a simple and efficient construction to facilitate precise adjustment of draw length, draw stop, draw force curve and/or other performance characteristics of the cam system or an associated archery bow. Where included, the draw stop is selectively moveable and can be adjusted to a variety of different locations to customize the draw stop for an archer. The indexing features, where included, provide accurate and precise registration between a module and a cam, which can provide a more finely-tuned cam system and prevent premature wear on components thereof. In addition, in cam systems where the module includes an axle recess, the module can be quickly removed and exchanged with another module if desired.

These and other objects, advantages, and features of the invention will be more fully understood and appreciated by reference to the description of the current embodiment and the drawings.

DETAILED DESCRIPTION OF THE CURRENT EMBODIMENT

Figure 1:
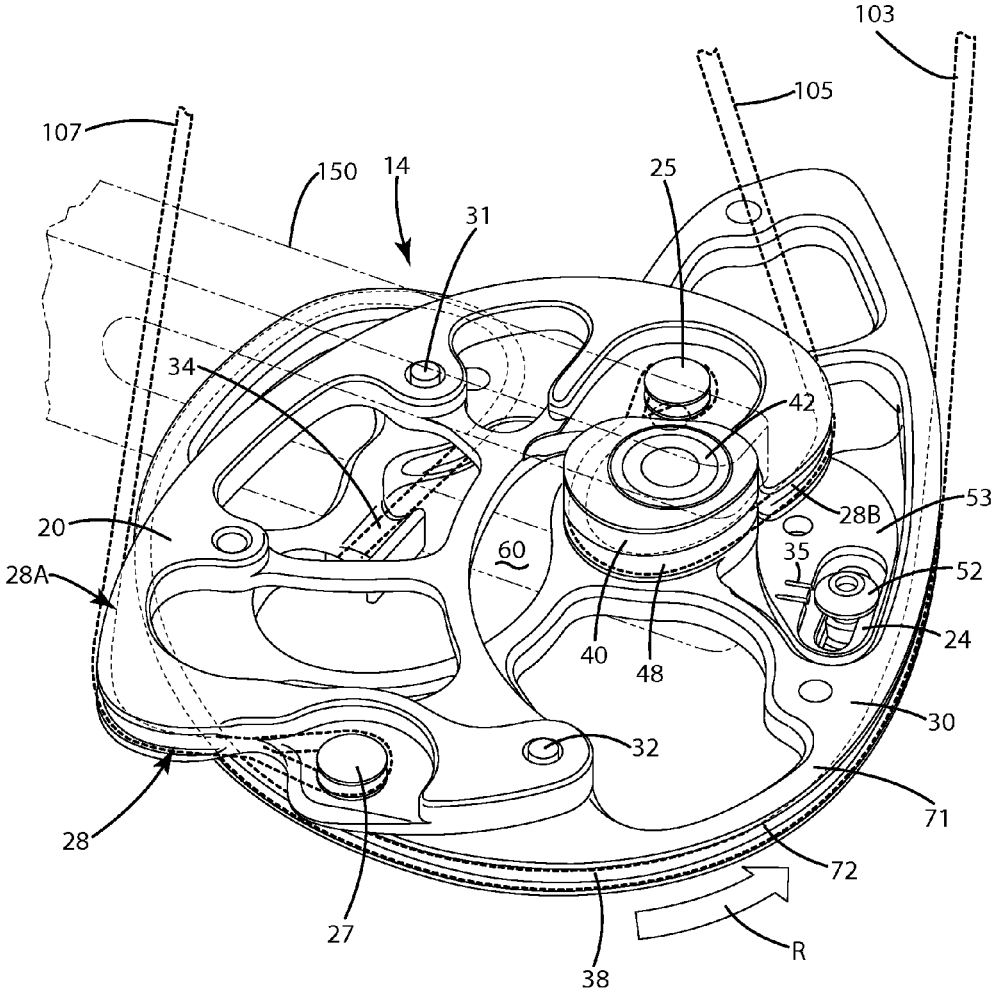
FIG. 1 is a perspective view of a current embodiment of a cam assembly joined with a lower limb of a bow in an undrawn state.

A cam system in accordance with a current embodiment is illustrated in FIGS. 1-7 and generally designated 10. This cam system 10 can include upper and lower cam assemblies 12 and 14 of a dual cam system on a bow 100, with the upper cam assembly 12 mounted to an upper limb 160 and the lower cam assembly 14 mounted to a lower limb 150 of a bow 100. In general, the lower and upper cam assemblies can include the same components, and can operate in a similar manner. Accordingly, only the lower cam assembly 14 will be described in significant detail herein, with the understanding that the upper cam assembly 12 can include the same components and can operate in a similar manner.

Although the current embodiment is described in connection with a dual cam system, the cam assemblies, adjustment modules, and other features are suited for use with more simple pulley systems, for example, in a single cam system. In such a system, for example, the lower cam assembly 14 can be paired with a circular pulley (not shown) mounted on the upper limb. The cam assembly, module and features also can be used in other dual cam, cam and a half and single cam systems as well. Although illustrated in connection with a particular cam system, the embodiments herein are well suited for cams of single cam compound archery bows, dual cam bows, cam and a half bows, crossbows and other archery systems including a cam and/or a pulley. Additionally, as used herein, a cam refers to a cam, a pulley, and/or an eccentric, whether a module or an integral part of a cam assembly, used in connection with a bow.

Further, as used herein, a module refers to a component, optionally including a cable groove and/or a bowstring groove, that can be joined and disjoined from a cam assembly to provide some level of adjustment of a performance characteristic of a bow, including but not limited to, a particular draw length, draw stop and/or draw force for the bow. The adjustment can be provided via a single module, or by interchanging one module for another module, where the modules have at least one different performance characteristic.

Figure 5:
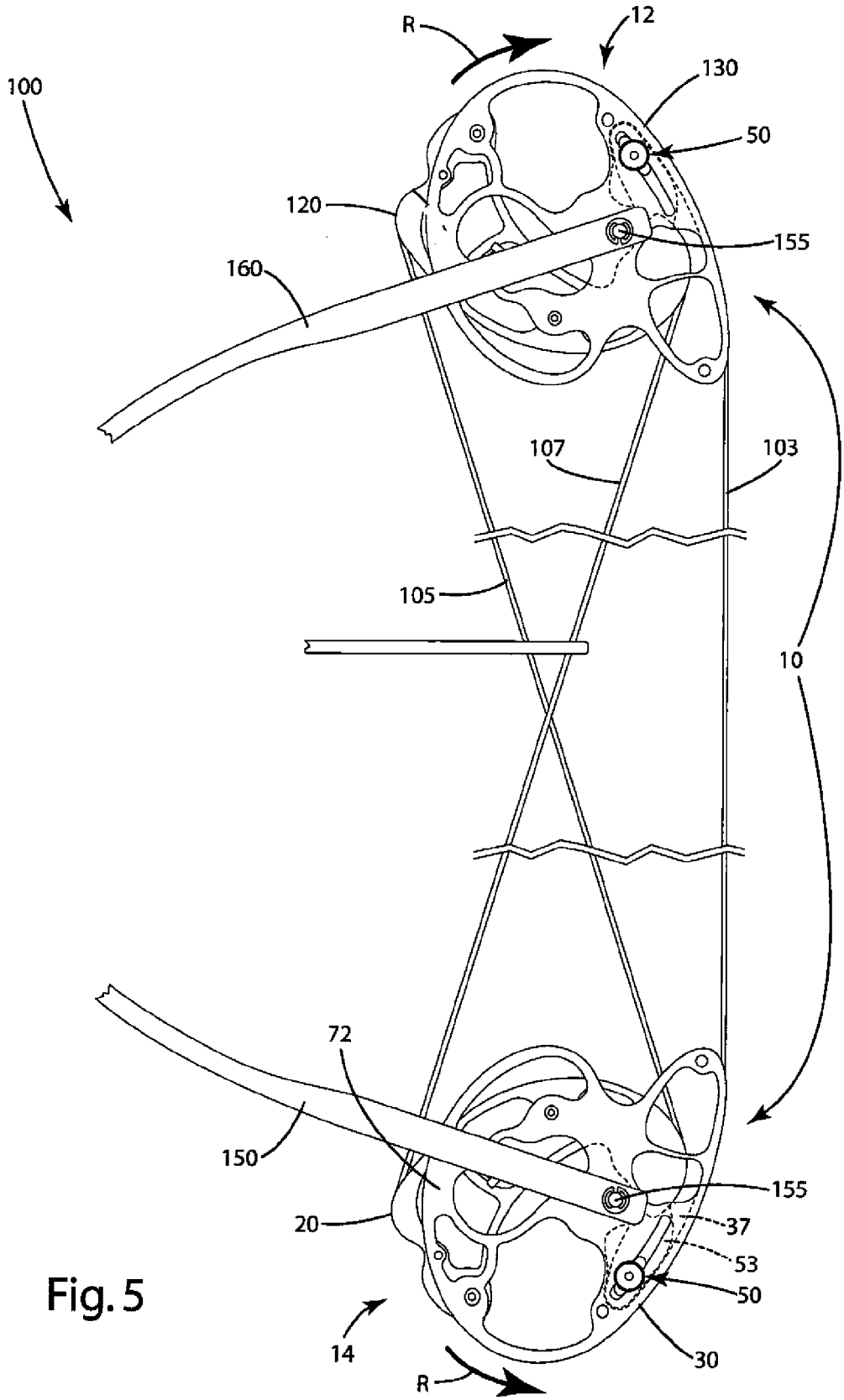
FIG. 5 is a perspective view of cam assemblies of a cam system on the bow, with the bow in an undrawn state.

The cam system 10 (FIG. 5), and in particular the cam assembly 14 (FIG. 1), generally includes an adjustment module 20 joined immovably with the cam 30. Module 20 and cam 30 can be detachably or releasably joined to one another with suitable fasteners to function as a unit in a fixed spatial relationship relative to one other. In general, the module and cam are separate and independent components which are pre-constructed and selectively joined with one another based on the desired performance characteristics of the bow 100 (FIG. 5). The cam and/or module can be formed from rigid material, such as a metal, optionally aluminum, titanium, or magnesium, or a non-metal, optionally composites and/or polymers.

Referring to FIGS. 1-4, the cam 30, which may also be referred to herein as a bowstring cam, defines a bowstring groove 38 around at least a portion of its outer perimeter, and can include an anchor 34 to which an end of the bowstring 103 connects. The anchor 34 can be in the form of a post, including flanges that capture a loop formed at the end of the bowstring 103. Optionally, the anchor can be in the form of a slot or recess (not shown) defined by the cam that captures the end of the bowstring, or that captures an attachment rod (not shown) attached to the end of the bowstring.

The bowstring groove 38 can be configured to accept the bowstring 103, which can wrap from the anchor post 34 around a substantial portion of the perimeter of the cam 30. Generally, the bowstring groove 38 lays in a plane that extends perpendicular to the axis of rotation of the cam 30 about an axle 155 that attaches the cam to a limb 150 of the bow 100. The cam 30 can be in a plane substantially parallel to the bowstring 103 when the bow is in an un-drawn state.

Figure 2:
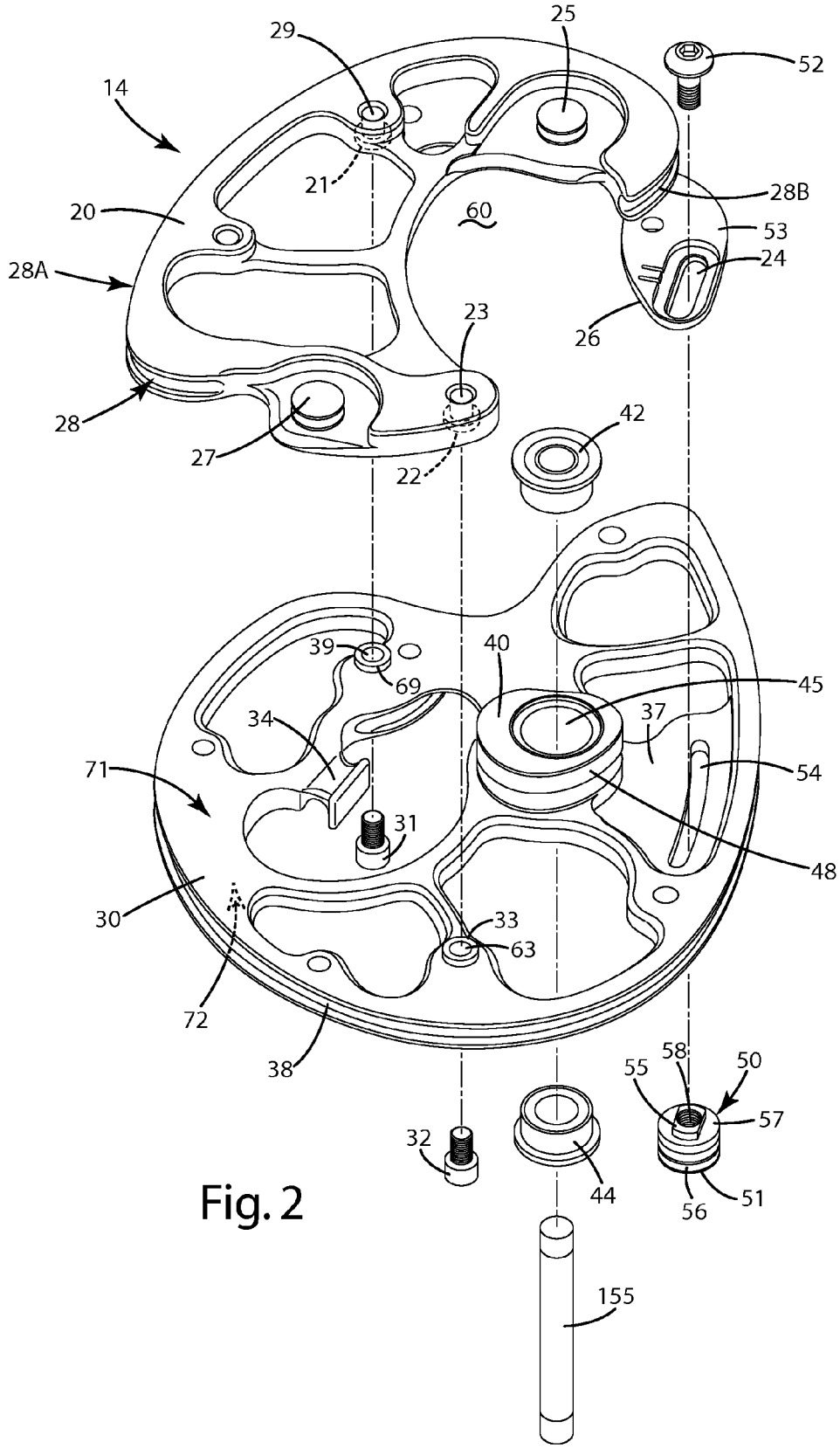
FIG. 2 is an exploded view of the cam assembly of FIG. 1.

As illustrated in FIG. 2, the cam 30 can include a boss 40. The boss 40 can be joined with the cam 30 via fasteners, or can be monolithically formed with the cam 30. The boss 40 can include bushings or bearings 42 and 44 included in a bore 45 defined by the boss 40. The bearings can be threaded into the bore, or they can be press fit into the bore, or joined in some other manner with the boss and/or cam, or not included at all. Where included, the bearings 42 and 44 can be configured to mate with the axle 155 so that the cam assembly 10 can freely rotate, or rotate a desired amount, around the axle 155.

The boss 40 can include a boss groove 48 that circumferentiates or surrounds at least a portion of the perimeter of the boss 40, and optionally the entire perimeter of the boss 40. As shown in FIG. 1, the boss groove 48 can be aligned with the cable groove 28 of the module 20 so that cable 105 tracks in both the boss groove 48 and the cable groove 28. The boss groove can be configured to provide a minor portion of the complete cable groove, and the module 20 can form a major portion of the same cable groove. Optionally, although not shown, the bowstring cam 30 can include other additional grooves for secondary or other power cables when it is implemented in cam systems having other configurations.

The cam 30 also can include a first surface 71 and an opposing surface 72, generally located on opposite sides of the cam 30. The first surface 71 can face toward the adjustment module 20 and the second surface 72 can face away from the adjustment module 20. In certain embodiments, as explained below, the draw stop 50 can be positioned adjacent the second surface 72, and also can project generally in a perpendicular manner, away from the second surface 72 of the cam.

The cam 30 can define a space in the form of a recess 37 that captures or houses at least a portion of a draw stop flange 53 which is joined with the module 20 as described below. This recess 37 may define a floor or bottom in which a draw stop cam slot 54 is defined. The draw stop cam slot 54 can be of a curvilinear configuration as shown, or can be of a linear configuration, or can be of combined linear and curvilinear configurations. The draw stop cam slot 54 can also be in communication with and generally aligned with the module draw stop adjustment slot 24 defined by the module 20. This module draw stop adjustment slot 24 can also be of a linear, curvilinear or combination of linear and curvilinear configurations. Further, in some applications, the floor and draw stop cam slot 54 can be completely absent from the cam 30, so that the draw stop joins with the module 20 via only the module draw stop adjustment slot 24, or some other element joined with the adjustment module 20.

The cam 30 and module 20 are joined with one another in the finished and installed cam assembly 14. These components are generally attached in a releasable manner, so that the module 20 can be removed from the bowstring cam 30, and vice versa. This enables a user to remove one module and replace it with a second module having different performance characteristics as mentioned above. Optionally, the module 20 and cam 30 can be joined by fasteners threaded in corresponding holes in the respective cam and/or module, or via some other mechanism.

As shown in FIGS. 1 and 2, the cam 30 and module 20 can include one or more indexing features to precisely align those components for attachment to one another. The cam 30 can include cylindrical posts or bosses 33 and 39 extending upward away from the surface 71. Optionally, the posts on the cam 30 can be replaced with any projection that can interfit within or otherwise align with features on the module 20. As illustrated, however, the module 20 can define corresponding cylindrical holes 22 and 21. The holes can extend partially or fully through the module 20. The posts 33 and 39 can fit within the holes 22 and 21 to align the cam and the module. The tolerances between the posts and holes can be very tight to provide precise and accurate alignment of the cam and module.

Although shown with the posts on the cam 30 and the holes on the module 20, these respective elements can be interchanged. For example, the holes can be defined by the cam, and the posts can be defined by the module. If desired, one post can be included on the cam and another post on the module. The respective holes for these posts can be defined on the other of the respective cam and module. Moreover, any number of posts and holes can be used. In general, if only one post is used, and it is cylindrical, it aligns the cam and module with one another in a preselected spatial configuration. If an additional post and hole are used, then the first post and the additional post can prevent rotation of the cam and module relative to one another.

Further, although shown as being generally cylindrical, the posts and holes can be of a variety of geometric configurations. For example, they can be rectangular, triangular, elliptical, trapezoidal, or of any other shape. Optionally, where of a non-circular or non-cylindrical configuration, the post and respective hole can interlock to prevent rotation of the cam relative to the module.

The cam 30 can define post holes 63 and 69, which can be defined in the posts 33 and 39 respectively. These holes can be slightly larger in diameter than fasteners 31 and 32 positioned therethrough. These fasteners also can be in the form of threaded screws that are co-axial with threaded holes 29 and 23 defined by the module 20. The indexing posts and holes can operate to align the cam and module with one another, while the fasteners 31 and 32 can join the module 20 fixedly and immovably, but detachably, to the cam 30. Of course, the indexing posts and holes can be completely separate and distal from the fasteners 31, 32 and respective holes 21, 22, if desired.

Although shown in conjunction with an adjustment module and a bowstring cam, the indexing features above can be used to align and a variety of components used in a cam system. For example, the indexing feature may be used to align an adjustment module, in the form of a cam, or only a portion of a cam, designed to accommodate a power cable and/or bowstring, with a bowstring cam, or some other cam or feature of a cam system.

As shown in FIGS. 1-4 and mentioned above, the cam system 10, and in particular the cam assembly 14, includes an adjustment module 20. This adjustment module 20 can be configured to provide some level of adjustment of a performance characteristic of a bow, including but not limited to, a particular draw length, draw stop and/or draw force for the bow, or some other performance characteristic, or to otherwise synchronize cams in a cam system. In general, the adjustment module can be in the form of a cam or pulley adapted to receive at least a portion of one or more power cables and/or the bowstring of the bow if desired. The adjustment module 20 can include a cable groove 28 defined in at least a portion of its outer periphery, and one or more cable anchors 25 and 27. These cable anchors can be in the form of posts or other structures as described above in connection with the bowstring anchors.

As illustrated, the module 20 can be constructed so that the power cable 107 tracks in the power cable take up groove 28A and the other power cable 105 tracks in the power cable let out groove 28B. Both of these grooves optionally can be part of a continuous groove 28. Optionally, the grooves 28A and 28B can be separated, and indeed can be located on different modules or cams positioned laterally adjacent one another if desired. Further, although not shown, the groove can be constructed from multiple pins projecting from the module, rather than a U, J or V shaped groove or track.

The module 20 can also define an open axle recess 60. With this open axle recess 60, neither the module 20 nor any of its components completely circumferentiate or otherwise surround the circumference of the axle, or the axle 155 in general, which joins the cam assembly 14 to the limb 150.

The perimeter of the module 20 can include the recess 60 through which the axle 155 extends orthogonally, so that the module 20 does not capture the axle within the perimeter. Accordingly, the module 20 can be separated from the cam 30 and repaired, adjusted, or replaced with another module having, for example, a different groove configuration, without removing the cam assembly 14 from the axle 155 or assorted limb 150. As illustrated, the entire adjustment module 20, including both the take up and let out grooves 28A and 28B can be removed simultaneously from the cam 30. Of course, if the adjustment module does not include both take up and let out grooves, whatever grooves are on the module can be removed in whole or part when the module 20 is removed from the assembly 14, or the cam 30 in particular.

Optionally, the open axle recess 60 can also be configured so that it surrounds or otherwise fits around at least a portion of the bearing boss 40, and generally enables the cable boss groove 48 to align with and generally continue the cable groove 28, and in particular groove 28B of the adjustment module 20. Of course, where the cam system 10 does not include a boss groove, the recess can simply surround a part of the axle or some other structure of the system as desired.

In addition to the above recess 60, the cam module 20 and the bowstring cam 30 optionally can include multiple openings defined completely therethrough to lighten the respective cams, or to provide weight in desired locations and promote a particular performance of the cam assembly.

Figure 4:
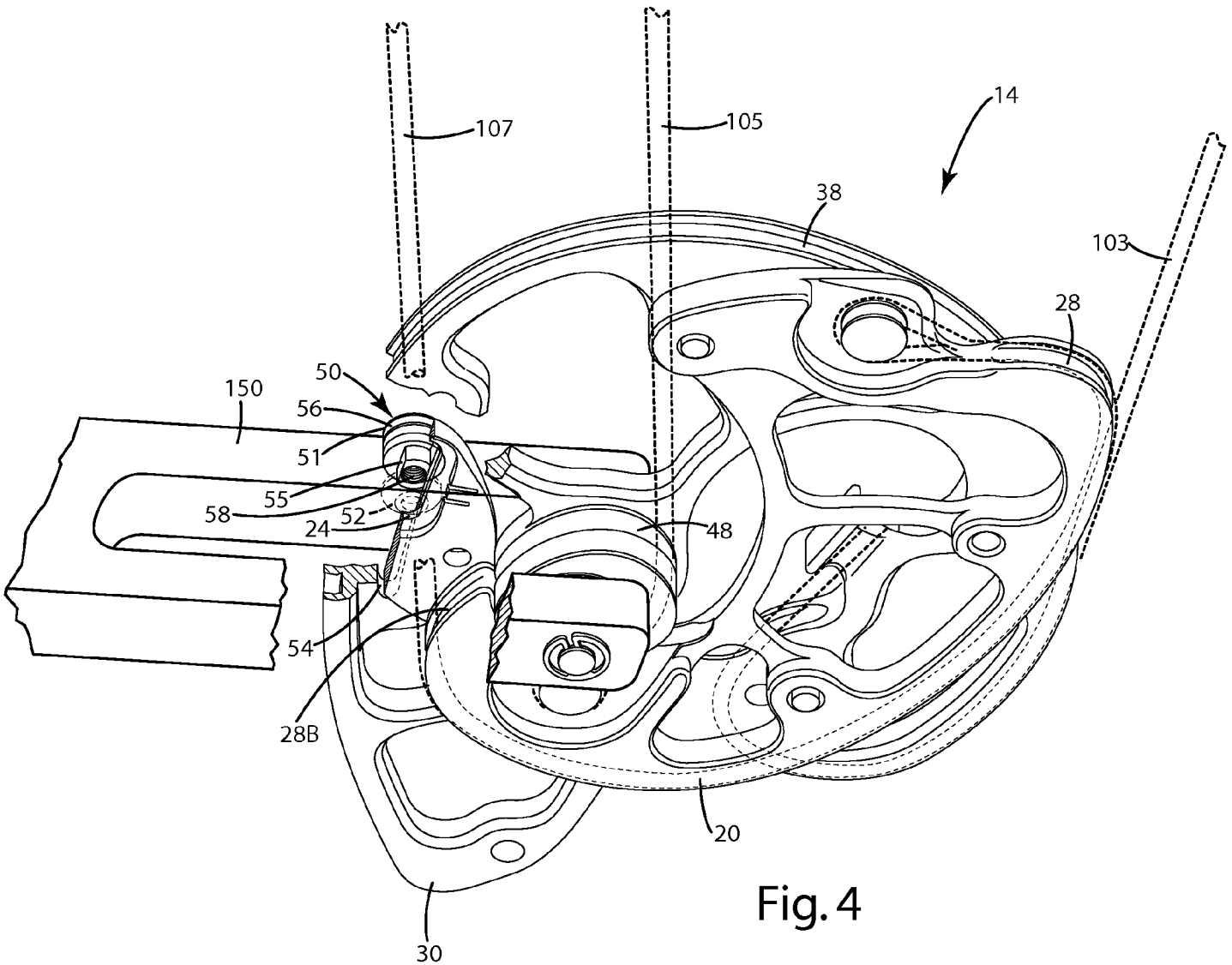
FIG. 4 is a perspective view of the cam assembly joined with the lower limb with the bow in a drawn state.

The cam assembly 14 also can include a draw stop 50 joined with the adjustment module 20. The draw stop 50 can include a fastener 52 and a draw stop body 51. The fastener 52 can be any fastener, but as shown, is in the form of a screw or threaded element. Alternatively, the draw stop body 51 can include a threaded portion which projects therefrom with a nut (also referred to as a fastener herein) joined to the threaded portion. While the draw stop body 51 can take a variety of geometric shapes such as rectangular, triangular, or trapezoidal shapes, it is shown as generally cylindrical, and includes a first end and a second end 57. The second end 57 includes a registration element 55, which is generally in the form of one or more tabs that extend from the second end 57 adjacent the hole 58 defined by the body 51. The registration element 55 can register within the cam slot 54 and/or the module slot 24 (FIGS. 2, 4). With this registration, the body 51 generally can be non-rotatable relative to the slot(s). Accordingly, when the fastener 52 is tightened, the body 51 can be held in a fixed rotational position.

The draw stop body 51 also can define at least one annular recess for retention of shock and sound absorption ring of a resilient material such as, but not limited to, an O-ring 56. The draw stop body can be machined or otherwise formed from metal, optionally aluminum, or molded from a suitable composite material.

Figure 3:
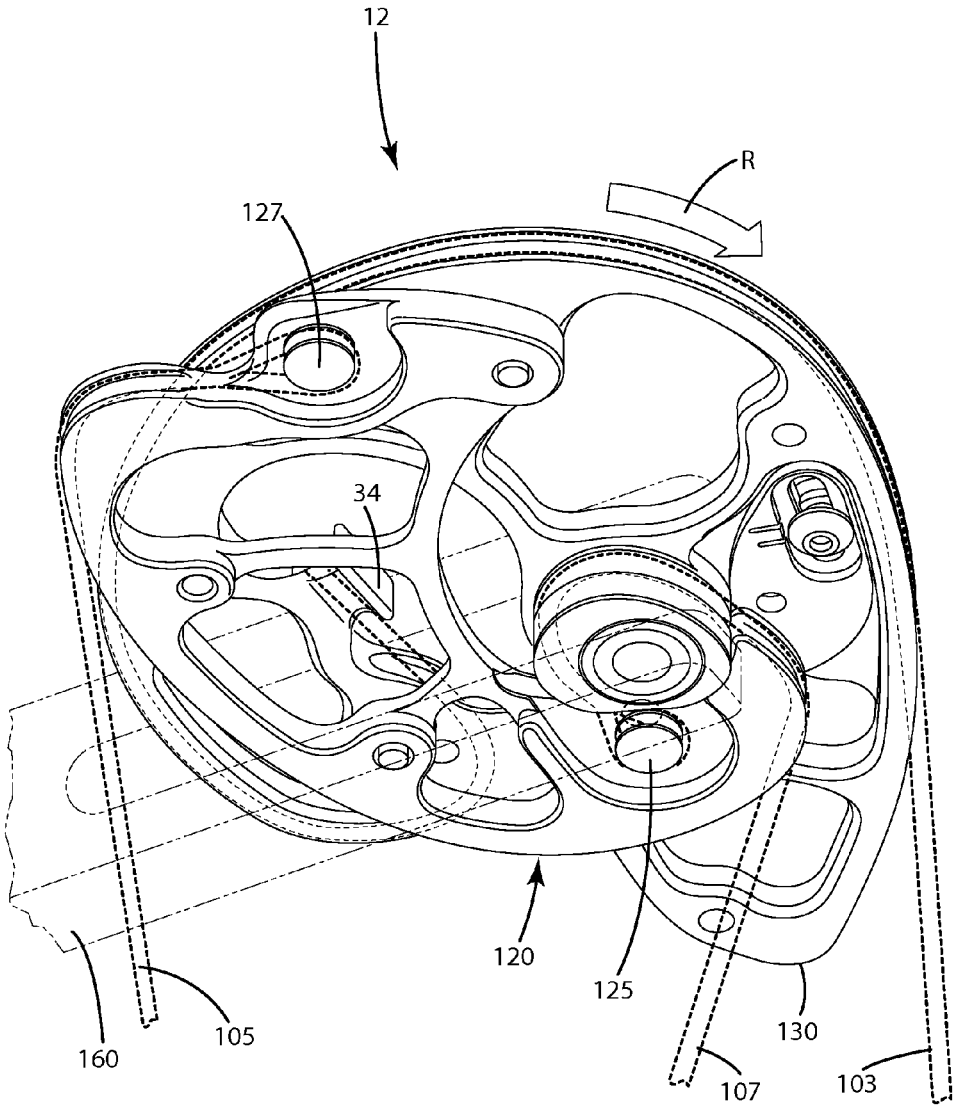
FIG. 3 is a perspective view of another cam assembly joined with an upper limb of a bow in an undrawn state.
Figure 7:
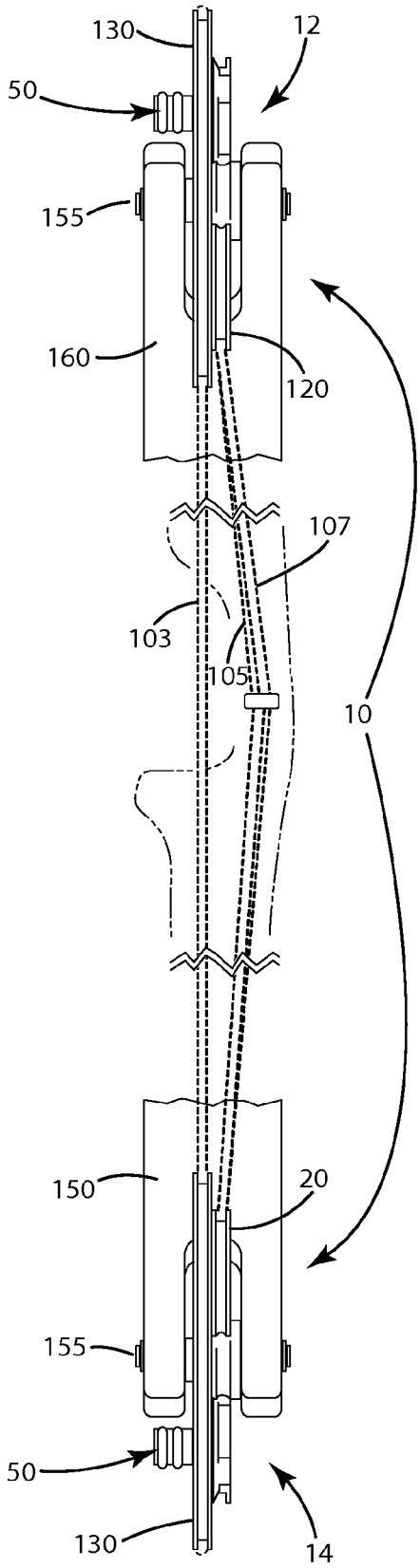
FIG. 7 is a an end view of the cam assemblies of the cam system on the bow.

The draw stop 50 generally extends beyond the side surfaces of the cam adjustment module 20 and bowstring cam 30. As shown in FIGS. 3 and 7, the draw stop 50 can extend generally perpendicular to the side surfaces of the module 30 and the cam 30. More specifically, the draw stop 50 can extend away from cam surface 72, generally facing away from the adjustment module 20, and generally positioned on the opposite side of the cam 30 from the module 20.

Figure 6:
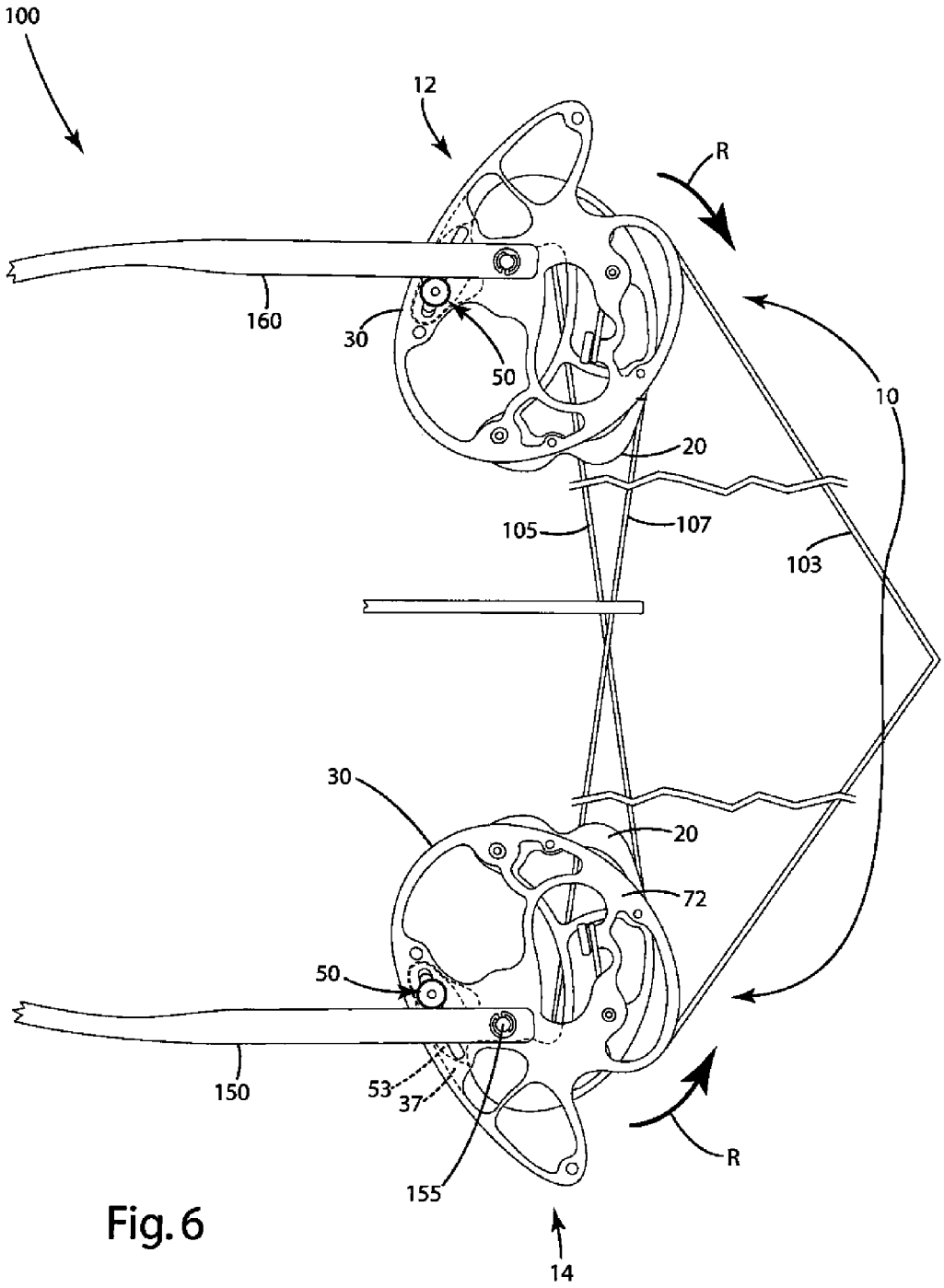
FIG. 6 is a perspective view of the cam assemblies of the cam system on the bow, with the bow in a drawn state, and draw stops engaging limbs of the bow.

The draw stop 50 can include an axis that is parallel to the axle 155. As illustrated in FIG. 5, the draw stop 50 can be located relative to the adjustment module 20 so that it is generally located above or below the axles 155 of the respective upper 160 and lower 150 limbs when the bow 100 is in an undrawn, vertical state. When the bow 100 is drawn, the draw stops 50 rotate with the respective cam assembly 12, 14 as shown by the arrows R in FIG. 5 until the respective draw stops 50 engage the bottom of limb 160 and top of limb 150 of the bow, or some other structure as shown in FIG. 6. Optionally, the draw stops 50 can be moved so that they engage the bottom of limb 160 and top of limb 150 depending on the desired application.

The draw stop 50 can be of a sufficient length so that it can engage the limbs 150, 160 and prevent overdraw or otherwise limit rotation of the cams and/or modules. Optionally, the draw stop engages the limb when the bowstring cam and the adjustment module have rotated a preselected amount so that the draw stop impedes further rotation of those components. FIG. 5 illustrates the draw stops 50 engaging the respective limbs in a manner to impede or otherwise prevent further rotation of the cam assemblies 12 and 14.

As shown in FIG. 2, the adjustment module 20 can include a draw stop flange 53 that extends from the module 20. The flange can be generally flat, and can extend beyond the cable groove 28, or some other groove, defined by the adjustment module 20. This flange 53 can be configured to nest in or adjacent the recess 37 defined by the bowstring cam 37. If desired, the outer perimeter of the flange 53 and inner perimeter of the recess 37 can be virtually identical, or can have a few similar engagement surfaces to precisely locate the flange in the recess, depending on the application.

The flange 53, or some other portion of the adjustment module where a flange is not included, can define an adjustment module draw stop slot 24 as described above. This slot 24 can be surrounded in whole or part by a recess 26 if included. The recess can be of a depth to receive a head or other portion of the fastener 52 therein, so the fastener 52 does not interfere with movement of a cable into or out from the groove 28. To ensure the draw stop 50 is located in a desired position within the slot 24, and the slot 54 where included, the cam 30 and/or the adjustment module 20 can include optional indexing marks 35.

When assembled, the draw stop fastener 52 can be configured to fit through the corresponding draw stop adjustment slots 24 and 54 in the module 20 and cam 30 respectively. As mentioned above, these slots can be partially or entirely aligned with one another. Optionally, the cam slot 54 can be of a greater length than the module slot 24 to accommodate a variety of modules having different length or differently positioned slots 24. The head of the fastener 52 can be located in the recess 26 surrounding the slot 24 in the module 20. In the illustrated configuration, when the fastener 52 is joined with the draw stop body 51, it can be tightened sufficiently to immovably fix the draw stop body 51 relative to the adjustment module 20. In other words, the draw stop can be configured so it does not move when a force is exerted on it, for example, when it engages a limb when the cam system 10 is in a fully drawn state shown in FIG. 6.

In the assembled configuration, the fastener 52 can be joined with draw stop body 50 so that the fastener projects through the adjustment module draw stop slot 24, generally away from the module 20 and toward and/or at least partially through the bowstring cam 30. The draw stop body 51 itself, while joined directly with the module 20 via the fastener 52, can be positioned adjacent the second surface 72 of the bowstring cam 30. Of course, if desired, the draw stop body 51 can project away from both the module and the cam opposite from that which is shown. For example, the draw stop body 51 can extend away from the first surface 71 and outward from the module 20, without ever being located on the same side of the cam 30 as the second surface 72, and optionally without ever passing through the plane of the first surface 71.

Assembly of the cam system 10, and generally the bow 100 will now be described with reference to FIGS. 1-7. The limbs 150 and 160 can be pre-constructed and joined with a pre-constructed riser of the bow 100. The module 20 can be aligned in a preselected configuration corresponding to desired performance of the bow by registering the indexing features of those elements, and in particular the indexing posts 34 and 33 and indexing holes 21, 22. These elements can be further joined with fasteners 31 and 32.

After the cam assemblies 12 and 14 are assembled, as shown in FIGS. 1-4, the joined cams 30, 130 and modules 20, 120 can be rotatably mounted to bow limb 150, 160 by inserting the respective axles 155 through the bores of the bearings 42 and 44 (FIG. 2) and securing the axles 155 to the respective limbs (FIG. 5).

With the cam assemblies 12 and 14, and the cam system 10 in general, assembled on the bow 100, a bowstring 103 and cables 105, 107 can be strung on the cam assemblies 12 and 14 joined to the respective limbs 150 and 160 of the bow. For example, the ends of the up cable 107 and down cable 105 can be attached to their respective posts 27 and 25, and 127 and 125 on the modules 20 and 120. The bowstring 103 can be strung by attaching its ends to the respective bowstring anchor posts 34 and 134 on the cams 30 and 130. The bowstring 103 can be further installed in the respective bowstring grooves 38, 138 of the cams 30, 130.

To set a desired performance characteristic, such as a particular draw length, draw stop and/or draw force for the bow, the draw stop 50 (of both cams where a dual cam system, or of one cam where a single or cam and a half system) can be secured in the desired location relative to the adjustment module 20. This can be accomplished by tightening the draw stop fastener 52 to engage the draw stop body 51 and secure the body 51 at a preselected location relative to the respective adjustment module. Where the adjustment module includes a slot 24, this can entail positioning the draw stop 50 at a preselected location within the slot 24, and optionally in the cam slot 54 where included. Where the cam adjustment module 20 includes a recess 26, any optional head of the fastener 32 can be at least partially nested in the recess 26.

The draw stop 50 also can be synchronized with the module 20 and cam system by placing the draw stop body 51 at a preselected location relative to the adjustment module 20. With the draw stop 50 synchronized with the module, the potential for overdraw, which can be a safety concern, can be reduced.

Adjustment of the draw stop 50 of the present cam system 10 upon initial set up, or upon replacement of a module to provide a different performance characteristic or to otherwise synchronize the module 20 with the cam system 10 is relatively simple. Specifically, after being joined with the adjustment module 20, the draw stop 50 is selectively moveable relative to the adjustment module 20, even while the adjustment module 20 is joined with the bowstring cam 30 in a fixed position or orientation. The draw stop 50 can be adjusted to any one of many preselected locations, where each location corresponds to a different amount of rotation of the bowstring cam, and the respective cam assembly.

To selectively move the draw stop 50, a user can loosen the fastener 52 relative to the draw stop body 51. The user can then move the draw stop 50, for example, the body 51 and/or the fastener 52, relative to the slot 24, and optionally the slot 54 where included. In so doing, the draw stop body and/or fastener can slide a selected amount relative to the slot(s) and the module 20 until a new location of the draw stop 50 is achieved. Where included, the registration element 55 can slide in the slot(s) during this adjustment. When that preselected location (which can be either desired or arbitrary) is achieved, the fastener 52 can be retightened relative to the body 51 to join the draw stop 50 in a fixed immovable orientation relative to the adjustment module 20 and/or bowstring cam 30. At the preselected location, the draw stop can engage the bow limbs or other components when the bow is drawn as shown in FIG. 6, thereby providing a specific degree of rotation of the cam assembly, a corresponding pay out of the bowstring and/or cables with a resultant draw length, and/or other performance characteristic as noted herein.

The modules 20, 120 can be readily removed from the respective cam assemblies 12 and 14, by first releasing the tension on the cables 105, 107 and bowstring 103 in a bow press (if suitable or even needed) and then removing the fasteners 31, 32 and the draw stop fastener 52. The module 20 can then be disassembled from its respective cam 30, optionally without having to remove the respective axles from the limbs and/or cam assemblies 12, 14 due to the axle recess 60 of the adjustment module 20. A newly selected module, having a different performance characteristic, such as draw length, draw force curve, and/or something else, can then be joined with the existing cams 30, 130, while those cams remain on the limbs 150, 160 with their cam axles 155 fully installed in the respective limbs.

Optionally, the adjustment modules described herein can be supplied in kits, with two to five or more different modules having different performance characteristics provided with each kit. As an example, a kit can include one module configured for an archer having a draw length of 28 inches, one module configured for an archer having a draw length of 29 inches, and another module configured for an archer having a draw length of 30 inches. The archer or another user can select a particular module to install in place of a module already included on a cam assembly. The replacement of one module with another can be performed in the manner described above, and in most instances, without having to remove the axles from the bow. Likewise, the draw stop 50 can be easily moved to a preselected location to provide desired performance characteristics as mentioned above.

In operation, as shown in FIGS. 1 and 3-5, the cam assemblies 12 and 14 rotate in the direction of the arrows R when the bowstring 103 is drawn by an archer. This causes the bowstring 103 to be let out from the bowstring groove 38 as the cam 30 rotates. As the bowstring is let out, both the up cable 107 and down cable 108 track in the cable groove 28, and the respective take up 28A and let out 28B grooves. In so doing, the down cable 105 tracks out of the cable groove 28 when the cam assembly 10 is in the full, drawn state. The down cable 105 can remain in at least a portion of the bearing boss groove 48. The up cable 107 tracks further around the periphery of the module 20, being taken up by the cable take up groove 28A, as shown in FIGS. 1 and 5. When the bowstring 103 is released, the cam assembly 10 rotates in the opposite direction which returns the cam assemblies 12 and 14 to the undrawn states shown in FIGS. 1 and 3.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A compound bow comprising:

at least two limbs;

a bowstring;

a power cable;

a bowstring cam defining a bowstring groove and including an anchor, the bowstring groove adapted to receive the bowstring, the anchor adapted for attachment of an end of the bowstring to the bowstring cam, the bowstring cam adapted for rotation about an axle that is joined with at least one limb;

an adjustment module independently constructed from and releasably joined with the bowstring cam, the adjustment module adapted to join with the bowstring cam in a fixed position, the adjustment module defining a power cable take up groove and a power cable let out groove that are aligned with one another along a perimeter of the adjustment module, the adjustment module including an axle recess that circumferentiates only a portion of the axle that is joined with the at least one limb so that the entire adjustment module can be releasably removed from the bowstring cam without having to remove the axle from the at least one limb; and a draw stop joined with the adjustment module, the draw stop projecting away from the adjustment module and adapted to engage the limb when the bowstring cam and the adjustment module have rotated a preselected amount so that the draw stop impedes further rotation.

2. The compound bow of claim 1 comprising a first indexing post joined with one of the adjustment module and the bowstring cam, and a first indexing hole defined by the other of the adjustment module and the bowstring cam, wherein the first indexing post is positioned in the first indexing hole to align the bowstring cam and the adjustment module in a preselected configuration.

3. The compound bow of claim 2 comprising a second indexing post joined with one of the adjustment module and the bowstring cam, and a second indexing hole defined by the other of the adjustment module and the bowstring cam, wherein the second indexing post is positioned in the second indexing hole to further align the bowstring cam and the adjustment module in the preselected configuration, and to prevent rotation of the adjustment module and bowstring cam relative to one another.

4. The compound bow of claim 1 wherein the bowstring cam includes a first surface that faces toward the adjustment module and a second surface opposite the first surface, the second surface facing away from the adjustment module, wherein the draw stop is positioned adjacent the second surface opposite the first surface and projects in a direction perpendicularly away from the second surface opposite the first surface.

5. The compound bow of claim 4 wherein the draw stop includes a fastener and a draw stop body, wherein the fastener is joined with the adjustment module, wherein the draw stop body is positioned adjacent the second surface of the bowstring cam, wherein the fastener is joined with the draw stop body to immovably fix the draw stop body relative to the adjustment module.

6. The compound bow of claim 5 wherein adjustment module defines a slot, wherein the fastener is registered in and extends through the slot defined by the adjustment module, wherein the draw stop body and fastener can be moved relative to the slot, while the adjustment module is joined with the bowstring cam in the fixed position, to adjust the draw stop to a plurality of preselected locations, each location corresponding to a different amount of rotation of the bowstring cam.

7. The compound bow of claim 1 wherein the draw stop is selectively moveable relative to the adjustment module, while the adjustment module is joined with the bowstring cam in the fixed position, to adjust the draw stop to a plurality of preselected locations, each location corresponding to a different amount of rotation of the bowstring cam.

8. A compound bow comprising:

a pair of limbs;

a bowstring;

a power cable;

a bowstring cam defining a bowstring groove adapted to receive the bowstring, the bowstring adapted to rotate about an axle joined with at least one limb;

an adjustment module independently constructed from and releasably joined with the bowstring cam, the adjustment module adapted to join with the bowstring cam in a fixed position, the adjustment module defining at least one of another bowstring groove and a power cable groove; and a draw stop joined with the adjustment module, the draw stop being selectively moveable relative to the adjustment module, while the adjustment module is joined with the bowstring cam in the fixed position, to adjust the draw stop to a plurality of preselected locations, each location corresponding to a different amount of rotation of the bowstring cam.

9. The compound bow of claim 8 wherein the draw stop includes a fastener and a draw stop body, wherein the fastener is selectively joined with the draw stop body to immovably fix the draw stop body relative to the adjustment module in at least one of the plurality of preselected locations.

10. The compound bow of claim 9 wherein the draw stop is located above the axle when the archery bow is in an undrawn state.

11. The compound bow of claim 8 wherein the adjustment module defines an elongated slot, wherein the draw stop is selectively slideable within the slot when the draw stop is adjusted to at least one of the plurality of preselected locations.

12. The compound bow of claim 11 wherein the draw stop includes a fastener and a draw stop body, wherein at least one of the fastener and the draw stop body project at least partially through the slot, wherein the at least one of the fastener and the draw stop body is slideable within the slot to adjust the draw stop to at least one of the plurality of preselected locations.

13. A compound bow comprising:

a pair of limbs;

a bowstring;

a power cable;

a bowstring cam defining a bowstring groove adapted to receive the bowstring, the bowstring adapted to rotate about an axle joined with at least one limb;

a second cam independently constructed from and releasably joined with the bowstring cam, the second cam adapted to join with the bowstring cam in a fixed position, the second cam defining at least one of another bowstring groove and a power cable groove;

a first indexing post joined with one of the second cam and the bowstring cam, and a first indexing hole defined by the other of the second cam and the bowstring cam, wherein the first indexing post is positioned in the first indexing hole to align the bowstring cam and the second cam in a preselected configuration; and a second indexing post joined with one of the second cam and the bowstring cam, and a second indexing hole defined by the other of the second cam and the bowstring cam, wherein the second indexing post is positioned in the second indexing hole to further align the bowstring cam and the second cam in the preselected configuration, and to prevent rotation of the second cam and the bowstring cam relative to one another.

14. The compound bow of claim 13 wherein the second cam includes an axle recess that circumferentiates only a portion of the axle that is joined with the at least one limb so that the entire second cam can be releasably removed from the bowstring cam without having to remove the axle from the at least one limb.

15. The compound bow of claim 13 wherein the first indexing post defines a first aperture and the second indexing post defines a second aperture, wherein a first fastener is positioned in the first aperture and a second fastener is positioned in the second aperture.

16. The compound bow of claim 15 wherein the first and second fasteners engage and join the bowstring cam and the second cam.

17. The compound bow of claim 13 comprising at least two fasteners that join the bowstring cam and the second cam, wherein the fasteners are concentric with at least one of the first and second indexing posts.

18. The compound bow of claim 13 comprising at least two fasteners that join the bowstring cam and the second cam, wherein the fasteners are concentric with at least one of the first and second indexing holes.

19. The compound bow of claim 13 comprising a draw stop joined with the second cam.

20. The compound bow of claim 19 wherein the draw stop is selectively moveable relative to the second cam to adjust the draw stop, while the second cam is joined with the bowstring cam in the fixed position, to a plurality of preselected locations, each location corresponding to a different amount of rotation of the bowstring cam.

* * * * *